US005536201A

United States Patent [19]

Winkelmann

[11] Patent Number: 5,536,201

[45] Date of Patent: Jul. 16, 1996

[54] APPARATUS FOR SURFACE MACHINING

[75] Inventor: Wolfgang Winkelmann, Wolfach, Germany

[73] Assignee: Maschinenbau Griehaber GmbH & Co., Bad Rippoldsau-Schapbach, Germany

[21] Appl. No.: 264,573

[22] Filed: Jun. 23, 1994

[30] Foreign Application Priority Data

Jun. 24, 1993 [DE] Germany ..... 43 20 945.9

[51] Int. Cl.[6] ..... B24B 5/00

[52] U.S. Cl. ..... 451/162; 451/164; 451/168

[58] Field of Search ..... 451/162, 163, 451/164, 168, 169

[56] References Cited

U.S. PATENT DOCUMENTS

| | | | |
|---|---|---|---|
| 2,701,937 | 2/1955 | Murray | 451/168 |
| 2,726,491 | 12/1955 | Smedley | 451/168 |
| 2,901,871 | 9/1959 | Kluge, Jr. . | |
| 3,045,399 | 7/1962 | Sloan | 451/168 |
| 3,094,815 | 6/1963 | Pendergast | 451/168 |
| 3,116,572 | 11/1964 | Dreiling | 451/168 |
| 4,596,640 | 6/1986 | Inoue | 451/168 |
| 4,796,387 | 1/1989 | Johnson | 451/168 |
| 5,018,311 | 5/1991 | Malagrino, Jr. et al. . | |
| 5,058,325 | 10/1991 | Pineau | 451/317 |

*Primary Examiner*—M. Rachuba

*Attorney, Agent, or Firm*—Dennison, Meserole, Pollack & Scheiner

[57] ABSTRACT

An apparatus for the surface machining of workpieces with convex surfaces uses a grinding belt (11). Fresh grinding belt (11) is brought to the surface of the workpiece for machining by a belt feed device (28). The belt feed device (28) for conveying the grinding belt (11) has a hydraulic drive (27) or pneumatic drive.

14 Claims, 2 Drawing Sheets

APPARATUS FOR SURFACE MACHINING

FIELD OF THE INVENTION

The invention relates to an apparatus for the surface machining of workpieces with convex surfaces by means of a grinding belt, and in particular to an apparatus in which fresh grinding belt is brought to the workpiece surface to be machined by a belt feed device.

BACKGROUND OF THE INVENTION

For precision machining of straight or convex surfaces, for example of radial bearings or control cams, eg of a crankshaft or camshaft or the like, there are known superfinishing machines in which, for example, a superfinishing stone or a grinding belt is placed against the point to be machined (DE-OS 41 21 18). In this case, both the superfinishing stone and the grinding belt are placed against the grinding position with a predetermined contact pressure. With superfinishing stones, it has proved disadvantageous that, especially in the case of workpieces having highly curved surfaces, unacceptably high degrees of deformation occur because of the large forces applied by the superfinishing stone to the workpiece. Furthermore, it has been found that, especially when machining cams, differing pressure conditions and differing machining speeds occur, due to the constantly altering curvature of the workpiece surface. This has the consequence that uniform machining over the periphery of the cam is not achieved.

When a grinding belt is used, these disadvantages can be reduced, at least within certain limits. Both when using a superfinishing stone and when using a grinding belt, the workpieces rotate and oscillate at the same time, so as to produce the desired cross-grinding. Because it is partially wrapped around the point for machining, the grinding belt does not, like a superfinishing stone, lie linearly on the curved surface for machining, but bears against the latter over a circumferential angle, albeit a very small one. However, the grinding belt is worn down very rapidly, since the grinding grains are detached from the adhesive composite after a very short time. The grinding action of this region of the grinding belt then falls off rapidly and becomes inadequate.

Moreover, it has been found that both a superfinishing stone and a grinding belt become smeared with dirt from the surface of the shaft being machined, with the result that the free spaces between the grinding grains are clogged and the cutting action becomes considerably reduced. As a rule, the grinding belt becomes unusable because of this soiling. When a grinding belt is used it therefore has to be transported on a certain distance so that a region of fresh, unused grinding belt is brought to the point being machined.

In addition, grinding belts have the advantage that they detach the ferrite particles which are enclosed, particularly, in cast material and round off the edges of the breakage points. Admittedly, superfinishing stones also detach these hard ferrite particles, but no rounding of the edges of the breakage points takes place, so that a piece remains. When the workpiece which has been machined in this manner is used later, this piece can break off and cause damage. The broken-off piece passes inevitably into the oil circulation. Grinding belts moreover have the advantage that they round off, for example, the edges of oil outlet bores, etc.

As already mentioned, the belt has to be transported on after a certain period of use, since the used region is either soiled or worn. For this purpose, belt feed devices are provided, which transport the belt on, either continuously or stepwise or incrementally. Such belt feed devices are either equipped with electric motors or are provided with a stepping feed mechanism, with the result that when a new shaft is inserted in the machining apparatus, in particular when the bearing to be machined or the surface to be machined is gripped in a tong-like manner, the grinding belt is transported on by a certain distance. However, stepping feed mechanisms of this type have the disadvantage that they do not transport the belt continuously during the grinding procedure, as is necessary especially when machining relatively large bearing points, since the grinding belt wears too quickly. Hitherto, this problem has been resolved by raising the grinding belt from the machining point during machining, transporting it the desired distance and then returning it. This is not only complicated and time-consuming but as a rule does not give the desired superfinishing result, since the material is not ground continuously.

Furthermore, as a rule electrical drives are wide enough for a plurality of belt-grinding stations to be arranged next to one another only with a large spacing. Using such apparatus, camshafts having cams and bearing points which lie close to one another, for example, cannot be machined in one operation, since the individual belt-grinding stations, because of their width, cannot be placed so close to one another that all the cams or bearing points can be machined simultaneously.

OBJECT OF THE INVENTION

The object of the invention is to develop an apparatus for surface machining of the type described above, in such a way that the surface machining of workpieces with convex surfaces can be carried out more simply, more rapidly and more precisely.

SUMMARY OF THE INVENTION

According to the invention, there is provided apparatus for the surface machining of workpieces with convex surfaces by a grinding belt, unused grinding belt being brought to the surface of the workpiece to be machined by a belt feed device, wherein the belt feed device has a hydraulic drive or pneumatic drive for feeding the grinding belt.

By means of the hydraulic drive, the grinding belt can be transported either continuously during machining of the shaft or discontinuously, that is to say stepwise or intermittently. In addition to better use of the belts, in this way fresh grinding belt is constantly used, so that the material grinding at the surface can be determined precisely in advance and thus more precise machining, in particular a more precise final dimension, can be achieved. Regions with worn or detached grinding grains are constantly replaced by regions with fresh grinding grains. This also applies to soiled regions which have no grinding capability or only inadequate grinding capability. The hydraulic drive has the particular advantage that it can be constructed to be extremely narrow, so that the grinding belt devices can be arranged next to one another in the narrowest of spaces. In one embodiment, for example, a belt-grinding device has a width of 32 mm. Thus, in this embodiment, the individual machining points on the shaft can be arranged at 32 mm intervals. Honing oil, for example, can be used as the hydraulic medium.

The grinding belt can be transported continuously by the hydraulic drive during machining of, for example, a cam or a bearing point. If desired, transport can be stopped and resumed again at any place. In this way, the grinding belts can be transported, for example, stepwise, each time over short distances. Another possibility provides for the grinding belt to be at a standstill during machining and to be transported in between the machining procedures, for example when the workpiece is changed. During this workpiece change, the hydraulic drive can then also be reset.

In a preferred embodiment, the hydraulic drive is constructed as a linear motor. Linear motors have the advantage that they can be constructed to be very narrow and moreover have a relatively simple structure. Furthermore, linear motors can easily be manufactured and are low in noise. It is also possible to seal such hydraulic drives without problems.

In a further development, the hydraulic drive is provided with a tensioning device for the grinding belt. This tensioning device holds the grinding belt against the workpiece. Moreover, the tensioning device ensures that, when machining a camshaft in reverse operation, the belt is not drawn away from the supply reel or from the take-up reel.

For fixing the grinding belt after it has been drawn off the supply reel and before it runs onto the take-up reel, the conveyor belt device has one or preferably two, belt-clamping devices. In such a case, the belt-clamping devices are provided at the belt inlet and at the belt outlet. The grinding belt is held in non-slip manner by the belt-clamping devices, so that it is tensioned by the tensioning device and can lie on the machining surface with a predetermined contact pressure.

In a further development, it is preferred that the hydraulic drive has two differential cylinders, each having a working piston, and in particular for the working pistons to oppose one another. In this way, the grinding belt can be kept under tension and, as a result of the opposed movement of the two working pistons, the belt section drawn off by the one working piston is replaced with a fresh belt section by the movement of the other working piston. Advantageously each working piston is provided with a belt-clamping device.

In a preferred embodiment one working piston serves for drawing off the grinding belt, and the other working piston serves for tensioning. This is necessary particularly when machining a workpiece in a reversing operation, since in this case the grinding belt has to be permanently under tension.

To produce a tension and also a defined driving direction of the hydraulic drive, the working pistons have effective piston faces of different sizes.

For secure clamping of the front and rear ends of the grinding belt before transport is begun by the belt feed device, the output of the differential cylinders of the hydraulic drive is connected to a delayed-action precision choke valve. This ensures that when the hydraulic drive is started, first the grinding belt is clamped and then, once the delayed-action precision choke valve has opened the output of the differential cylinders, the pistons of the differential cylinders are moved, as a result of which the grinding belt is tensioned and transported.

Preferably, the supply speed of the grinding belt is adjustable by means of the precision choke valve. In this way, the amount of grinding belt used can be reduced to a minimum and yet optimum grinding results can be achieved. Moreover, the adjustable precision choke valve can be used to adapt the belt feed device to different workpieces.

Further advantages, features and details of the invention will be apparent from the description below, in which a particularly preferred embodiment is illustrated in detail with reference to the drawings, in which:

DETAILED DESCRIPTION OF THE DRAWINGS

Figure 1:
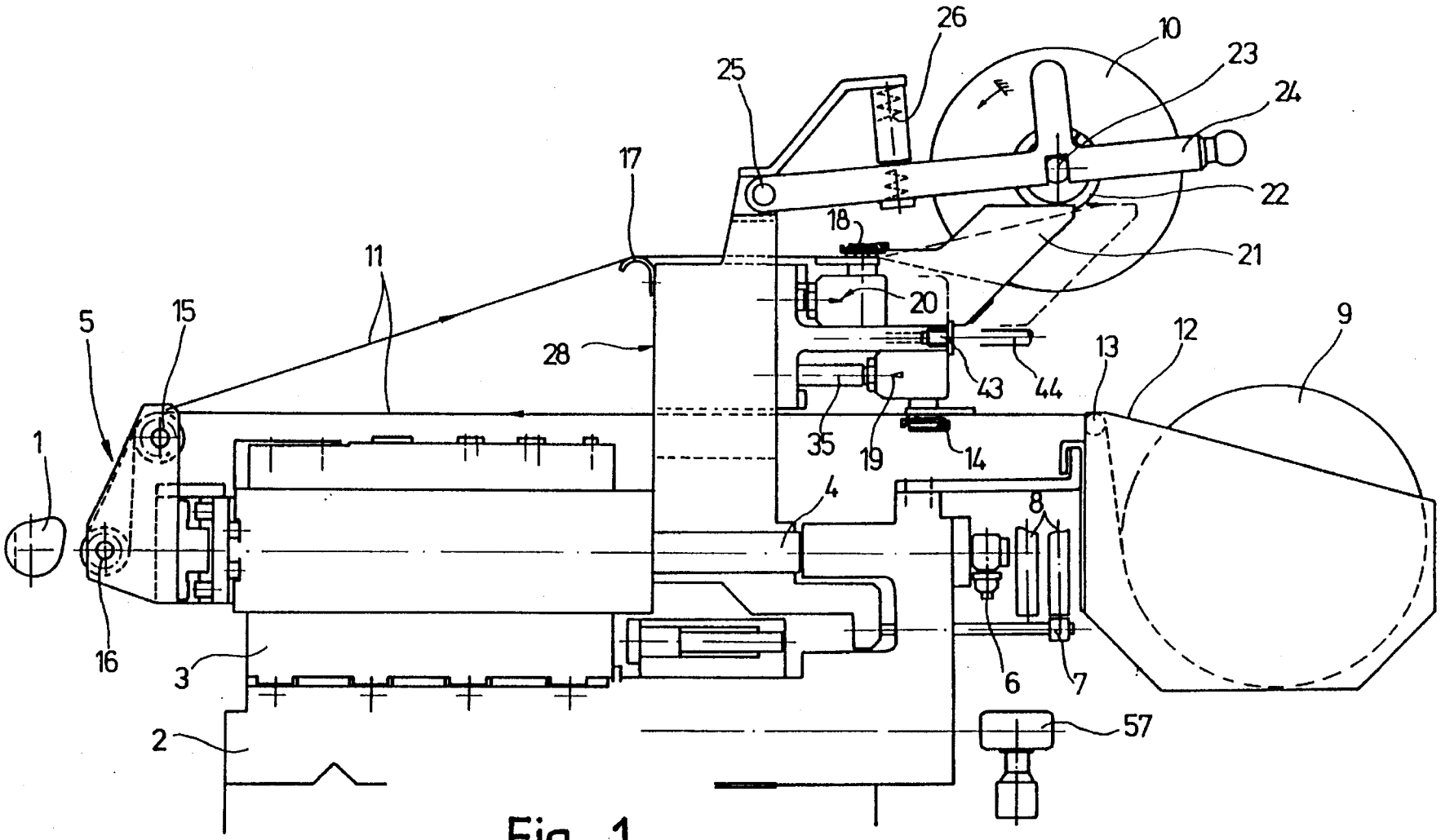
FIG. 1 shows a schematic side view of an apparatus for surface machining.

FIG. 1 shows an embodiment of the apparatus according to the invention for surface machining of workpieces with convex surfaces, e.g. a cam 1 of a camshaft. The apparatus has a slide 3 which is arranged on a machine frame 2 and is displaceable and lockable orthogonally to the plane of the drawing. In this way, several machining apparatus arranged next to one another can be aligned precisely with different cams of a camshaft. Mounted in the machining apparatus is a pushrod 4, by way of which a machining head 5, which in FIG. 1 is secured to the left-hand end of the pushrod 4, can be moved in the direction of the cam 1 and can be raised away therefrom again. The pushrod 4 is driven hydraulically or pneumatically, a hydraulic or pneumatic connection 6 being illustrated schematically. In addition, there is secured to the pushrod 4 a position indicator 7 which cooperates with two position detectors 8. The limit positions of the pushrod 4 or of the machining head 5 can be detected by the position detectors 8, so that further control devices can be actuated in response to this information.

FIG. 1 furthermore illustrates a supply reel 9 and a take-up reel 10 for a grinding belt 11. The supply reel 9 lies loosely in a reel box 12, the grinding belt 11 being unwound clockwise from the supply reel 9. The grinding belt 11 is guided by way of a first deflection roller 13 and a first clamping device 14 in the direction of the machining head 5. There, the grinding belt 11 bears against a further deflection roller 15 and is wrapped around a contact pressure roller 16 in such a way that the grinding belt 11 is guided over the deflection roller 15 again in the direction of the take-up reel 10. First, however, the grinding belt 11 is guided by way of a deflection device 17 and runs through a second clamping device 18.

It can be seen from FIG. 1 that by applying a suitable hydraulic or pneumatic pressure to the connection 6, the pushrod 4 is displaced in the direction of the cam 1 and thus the grinding belt 11 is pressed, by the contact pressure roller 16, against the surface of the cam 1 to be machined.

Feeding of the grinding belt 11 is achieved by the two clamping devices 14 and 18 being displaced in the direction of the arrows 19 and 20. This can be done during machining of the cam 1, so that unused grinding belt 11 is continuously supplied to the machining point. However, the belt can also be fed after machining of a cam 1 if the machining head 5 is withdrawn completely from the cam 1, as illustrated in FIG. 1, before the machining head 5 is placed against the next cam 1 for machining. A further possibility for feeding the belt is that the grinding belt 11 may be transported intermittently or stepwise during machining of a cam 1. In this case, the machining head 5 can lie permanently against the cam 1 with a constant or reduced pressure, or the machining head 5 can be raised away from the cam 1 slightly. Connected to the clamping device 18 is a drive apparatus 21 in the form of a wedge, by way of which the take-up reel 10 is driven. If the clamping device 18 moves in the direction of the arrow 20, then at the same time the drive apparatus 21 is moved to the right. The drive apparatus 21 bears against a drive roller 22 of the take-up reel 10, the drive roller 22 being mounted by way of a freewheel to be freely rotatable anticlockwise on a shaft 23. The shaft 23 is held in a cutout of a contact pressure arm 24, which is mounted pivotally about a bearing 25. Moreover, the contact pressure arm 24 is acted upon by the force of a spring 26, as a result of which the drive roller 22 is pressed against the drive apparatus 21. Because of the movement of the drive apparatus 21, the drive roller 22 is made to rotate and winds on the grinding belt 11 supplied from the clamping device 18. Before return movement of the two clamping devices 14 and 18 opposite to the direction of the arrows 19 and 20, the clamping devices 14 and 18 are opened so that they release the grinding belt 11. Drawing off of the grinding belt 11 from the take-up reel 10 is prevented by reverse rotation of the take-up reel 10 being blocked by way of the freewheel. The drive apparatus 21 slides back into its initial position below the drive roller 22.

Figure 2:
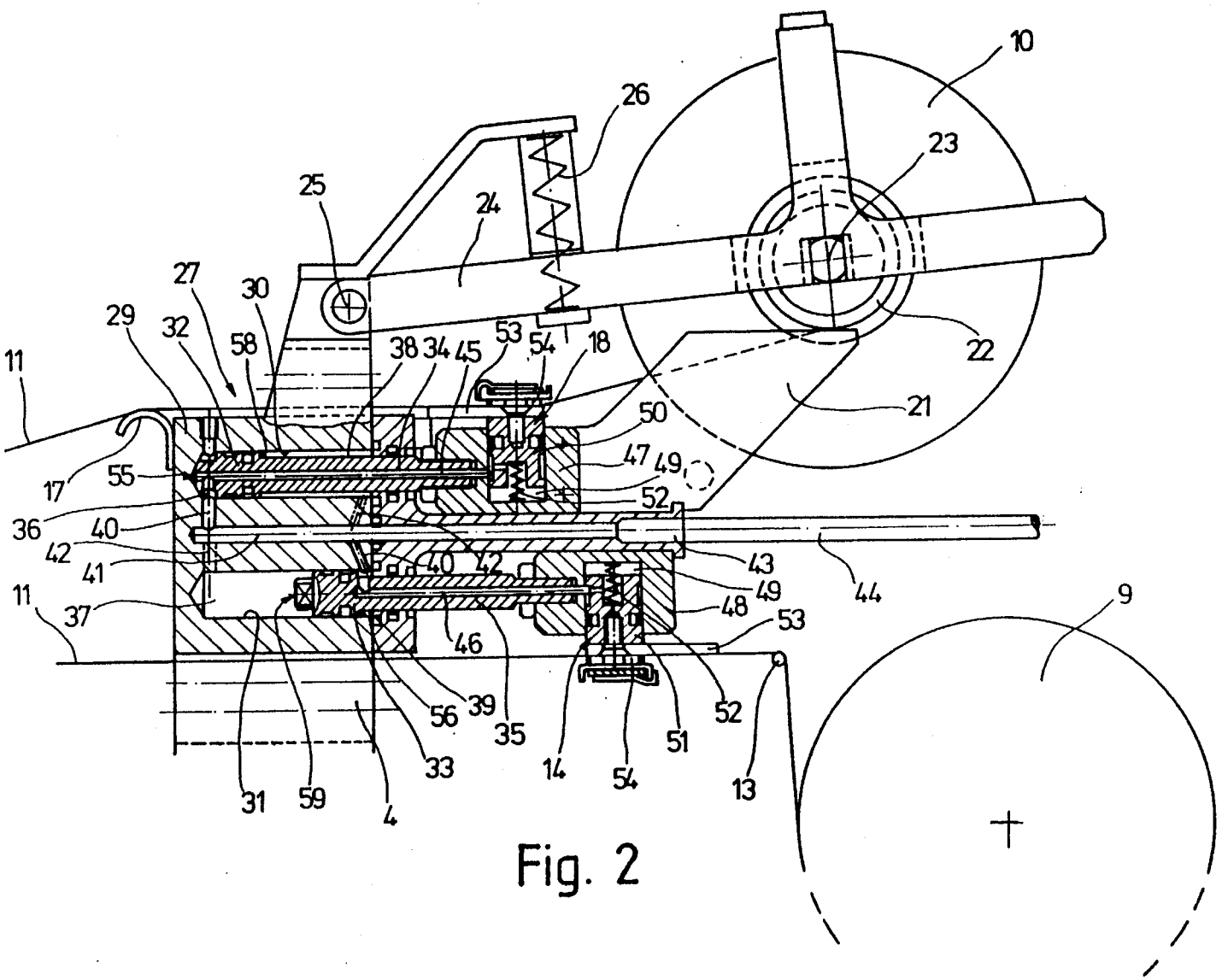
FIG. 2 shows a vertical section through a hydraulic drive forming part of the apparatus of FIG. 1, on an enlarged scale.

Referring now to FIG. 2, the belt feed device in the form of a hydraulic drive 27 will be explained in more detail. The hydraulic drive 27 has a housing 29 in which two cylinder bores 30 and 31 are formed. The cylinder bores 30 and 31 are substantially parallel and extend longitudinally the whole length of the machining apparatus. Two working cylinders 32 and 33 are inserted into these two cylinder bores 30 and 31, which are open at one end, and the two working cylinders 32 and 33 project by means of their piston rods 34 and 35 out of the two cylinder bores 30 and 31. The two clamping devices 18 and 14 are connected to the free ends of the piston rods 34 and 35. The clamping devices 18 and 14 are thus driven by way of the two piston rods 34 and 35 of the two working cylinders 32 and 33. The two working pistons 32 and 33 divide the cylinder bores 30 and 31 in each case into a chamber 36 and 37 on the head side and a chamber 38 and 39 on the rod side. The chamber 36 on the head side and the chamber 39 on the rod side are connected to a supply bore 41 by way of transverse bores 40. The chamber 37 on the head side and the chamber 38 on the rod side are connected by way of transverse bores 42, shown by dashed lines, to a supply bore which is not shown in FIG. 2. This supply bore lies directly behind the supply bore 41 and is thus covered by the supply bore 41. The connections 43 for the two supply bores lie directly next to one another. The numeral 44 indicates schematically a supply line for the supply bore 41.

It can furthermore be seen from FIG. 2 that the working piston 32 and the piston rods 33 and 34 are bored through axially. These central bores 45 and 46 open into the chamber 36 on the head side and, by way of the transverse bore, into the chamber 39 on the rod side, respectively. Consequently, they are connected by way of the transverse bores 40 and the supply bore 41 to the supply line 44. The two working cylinders 32 and 33 are screwed into two housings 47 and 48 of the clamping devices 18 and 14, with the central bores 45 and 46 being connected to pressure chambers 49. These pressure chambers 49 are delimited by a bore made in the housings 47 and 48 and in each case a piston 50 and 51 respectively mounted axially displaceably in this bore. These two pistons 50 and 51 are additionally driven out of the bore by the force of a spring 52. At the free end of the piston 50 and 51, there is provided a contact pressure plate 53 which can be pressed against hard metal elements 54. The grinding belt 11 is guided between the hard elements 54 and the contact pressure plate 53.

The operation of the hydraulic drive 27 will be now explained briefly. If the supply line 44 is acted upon by pressurized hydraulic medium, e.g. hydraulic oil or honing oil, then this pressure bears both against the piston faces 55 and 56 of the chamber 36 on the head side and the chamber 39 on the rod side of the working pistons 32 and 33, and also in the two pressure chambers 49. The outlet of the hidden supply bore into which the chamber 37 on the head side and the chamber 38 on the rod side open is connected to a delayed-opening precision choke valve 57 (FIG. 1). Since this precision choke valve 57 does not respond immediately, the two working pistons 32 and 33 remain at rest, and only the two pistons 50 and 51 of the clamping devices 18 and 14 are moved and firmly clamp the grinding belt between the contact pressure plate 53 and the hard metal element 54. Shortly thereafter, the precision choke valve 57 opens, as a result of which the pressure in the chamber 37 on the head side and the chamber 38 on the rod side drops. Since the piston face 55 of the chamber 36 on the head side is larger than the piston face 58 of the chamber 38 on the rod side of the working piston 32, the working piston 32 moves to the right and draws the grinding belt 11 through the belt-grinding apparatus. The piston face 59 of the working piston 33 is accordingly larger than the piston face 56, so that a resultant force acts to the right on this working piston 33. As a result of this force, which depends upon the pressure difference between the two chambers 37 and 39 and the face difference between the two piston faces 59 and 56, the grinding belt 11 is held under tensile stress. However, the working piston 33 moves to the left at a speed corresponding to the speed of the working piston 32. In this way, the grinding belt 11 is held under tension and is transported on. The maximum stroke of the apparatus depends on the dimensions of the individual components; in the present embodiment, for example, it is 35 mm.

The hydraulic drive 27 is reset by the action of pressure on the chambers 37 and 38, whereas the chambers 36 and 39 are not pressurized, so that the clamping devices 14 and 18 also release the grinding belt 11. Drawing off of grinding belt 11 from the take-up reel 10 is prevented, as described above, by a freewheel inhibiting movement in the drawing off direction.

I claim:

1. Apparatus for the surface machining of convex surfaces on a workpiece by a grinding operation comprising:

a supply reel of unused grinding belt, a take-up reel for used grinding belt, means for pushing grinding belt against a surface to be machined, belt feeding means conveying unused grinding belt to said surface, said belt feeding means includes an arrangement having first and second clamping devices for clamping and tensioning the grinding belt during movement in a feeding direction, said first and second clamping devices releasing the grinding belt during movement opposite the feeding direction and, the belt feeding means includes a hydraulic drive in the form of first and second cylinders, said cylinders including working pistons operating in opposite directions, at least one of said working pistons being operatively connected to one of said clamping devices, the first cylinder working piston operating to draw off unused belt from the supply reel and the second cylinder working piston causing the grinding belt tensioning.

2. Apparatus as claimed in claim 1, wherein the belt feeding means conveys the grinding belt stepwise during the grinding operation.

3. Apparatus as claimed in claim 1, wherein the belt feeding means conveys the grinding belt intermittently during the grinding operation.

4. Apparatus as claimed in claim 1, wherein the belt feeding means conveys the grinding belt continuously during the grinding operation.

5. Apparatus as claimed in claim 4, wherein the belt feeding means includes a linear motor.

6. Apparatus as claimed in claim 1, wherein the first clamping device is near the supply reel and the second clamping device is near the take-up reel.

7. Apparatus as claimed in claim 1, wherein the working pistons have effective piston faces of different sizes.

8. Apparatus as claimed in claim 7, wherein a delayed action precision choke valve is provided and the cylinders of the hydraulic drive cooperate with said choke valve.

9. Apparatus as claimed in claim 8, wherein the speed of conveying the grinding belt is adjusted by means of the precision choke valve.

10. Apparatus as claimed in claim 1, wherein the working pistons have effective piston faces of different sizes.

11. Apparatus as claimed in claim 10, wherein a delayed action precision choke is provided and the cylinders of the hydraulic drive cooperate with said choke valve.

12. Apparatus as claimed in claim 11, wherein the speed of conveying the grinding belt is adjusted by means of the precision choke valve.

13. Apparatus for the surface machining convex surfaces on a workpiece by a grinding operation comprising:

a supply reel of unused grinding belt, a take-up reel for used grinding belt, means for pushing grinding belt against a surface to be machined, and belt feeding means for conveying unused grinding belt to said surface, said belt feeding means including a device for applying tension to the grinding belt in the form of a first clamp close to the take up reel, a second clamp close to the supply reel, a hydraulic drive having a first cylinder and a second cylinder, each cylinder having a working piston wherein the working piston operate in opposite directions, so that the first cylinder working piston serves to draw off unused belt from the supply reel and the second cylinder working piston serves to tension to the grinding belt, and each working piston is operatively connected to a clamp the first and second cylinder working pistons have effective piston faces of different size.

14. Apparatus as claimed in claim 13, wherein a delayed action precision choke valve is provided, the cylinders of the hydraulic drive cooperate with said choke valve and the speed of conveying the grinding belt is adjusted by means of said precision choke valve.

* * * * *